US010821729B2

(12) United States Patent
Chen et al.

(10) Patent No.: US 10,821,729 B2
(45) Date of Patent: Nov. 3, 2020

(54) TRANSFER MOLDED FLUID FLOW STRUCTURE

(71) Applicant: HEWLETT-PACKARD DEVELOPMENT COMPANY, L.P., Houston, TX (US)

(72) Inventors: Chien-Hua Chen, Corvallis, OR (US); Michael W. Cumbie, Albany, OR (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 416 days.

(21) Appl. No.: 14/770,402

(22) PCT Filed: Jul. 29, 2013

(86) PCT No.: PCT/US2013/052505

§ 371 (c)(1),
(2) Date: Aug. 25, 2015

(87) PCT Pub. No.: WO2014/133577

PCT Pub. Date: Sep. 4, 2014

(65) Prior Publication Data

US 2016/0009085 A1 Jan. 14, 2016

(30) Foreign Application Priority Data

Feb. 28, 2013 (WO) ..... PCT/US2013/028207
Feb. 28, 2013 (WO) ..... PCT/US2013/028216
(Continued)

(51) Int. Cl.
*B41J 2/14* (2006.01)
*B41J 2/16* (2006.01)

(52) U.S. Cl.
CPC ..... *B41J 2/14* (2013.01); *B41J 2/14016* (2013.01); *B41J 2/14201* (2013.01);
(Continued)

(58) Field of Classification Search
CPC .. B41J 2/1601; B41J 2/14016; B41J 2/14201; B41J 2/1607; B41J 2/1628;
(Continued)

(56) References Cited

U.S. PATENT DOCUMENTS 4,224,627 A 9/1980 Powell
4,460,537 A 7/1984 Heinle
(Continued)

FOREIGN PATENT DOCUMENTS

CN 1175506 3/1998
CN 1197732 A 11/1998
(Continued)

OTHER PUBLICATIONS

Miettinen et al; Molded Substrates for Inkjet Printed Modules; IEEE Transactions on Components and Packaging Technologies, vol. 32, No. 2, Jun. 2009 293; pp. 293-301.
(Continued)

*Primary Examiner* — Henok D Legesse
(74) *Attorney, Agent, or Firm* — Fabian VanCott

(57) ABSTRACT

In an embodiment, a fluid flow structure includes a micro device embedded in a molding, a fluid feed hole formed through the micro device, and a transfer molded fluid channel in the molding that fluidically couples the fluid feed hole with the channel.

20 Claims, 8 Drawing Sheets

(30) Foreign Application Priority Data

Mar. 26, 2013 (WO) ..... PCT/US2013/033865
Jun. 27, 2013 (WO) ..... PCT/US2013/048214
Mar. 20, 2015 (WO) ..... PCT/US2013/033046

(52) U.S. Cl.
CPC ..... *B41J 2/1601* (2013.01); *B41J 2/162* (2013.01); *B41J 2/1607* (2013.01); *B41J 2/1628* (2013.01); *B41J 2/1637* (2013.01); *B41J 2002/14419* (2013.01); *B41J 2002/14491* (2013.01); *B41J 2202/19* (2013.01); *B41J 2202/20* (2013.01)

(58) Field of Classification Search
CPC ..... B41J 2002/14491; B41J 2202/20; B41J 2202/19; B41J 2/1637; B41J 2/162; B41J 2002/14419
See application file for complete search history.

(56) References Cited

U.S. PATENT DOCUMENTS 4,633,274 A 12/1986 Matsuda
4,873,622 A 10/1989 Kornuro et al.
4,881,318 A 11/1989 Komuro et al.
4,973,622 A 11/1990 Baker
5,016,023 A 5/1991 Chan et al.
5,387,314 A * 2/1995 Baughman ..... B41J 2/1404 216/16
5,565,900 A 10/1996 Cowger et al.
5,841,452 A * 11/1998 Silverbrook ..... B41J 2/1404 216/27
5,894,108 A 4/1999 Mostafazadeh
6,022,482 A 2/2000 Chen et al.
6,123,410 A * 9/2000 Beerling ..... B41J 2/14024 347/42
6,132,028 A 10/2000 Su et al.
6,145,965 A 11/2000 Inada et al.
6,188,414 B1 2/2001 Wong et al.
6,190,002 B1 2/2001 Spivey
6,227,651 B1 5/2001 Watts et al.
6,250,738 B1 * 6/2001 Waller ..... B41J 2/14024 347/13
6,254,819 B1 7/2001 Chatterjee et al.
6,291,317 B1 9/2001 Salatino et al.
6,305,790 B1 * 10/2001 Kawamura ..... B41J 2/1404 347/65
6,379,988 B1 4/2002 Peterson
6,402,301 B1 6/2002 Powers
6,454,955 B1 9/2002 Beerling
6,464,333 B1 10/2002 Scheffefin et al.
6,543,879 B1 4/2003 Feinn et al.
6,554,399 B2 4/2003 Wong et al.
6,560,871 B1 5/2003 Ramos et al.
6,666,546 B1 12/2003 Buswell et al.
6,676,245 B2 1/2004 Silverbrook
6,767,089 B2 7/2004 Buswell et al.
6,930,055 B1 8/2005 Bhowmik et al.
6,962,406 B2 11/2005 Kawamura et al.
7,051,426 B2 5/2006 Buswell
7,185,968 B2 3/2007 Kim et al.
7,188,942 B2 3/2007 Haines
7,490,924 B2 2/2009 Haluzak et al.
7,543,924 B2 6/2009 Silverbrook
7,591,535 B2 9/2009 Nystrom et al.
7,614,733 B2 11/2009 Haines et al.
7,658,470 B1 2/2010 Jones et al.
7,824,013 B2 11/2010 Chung-Long-Shan et al.
7,828,417 B2 11/2010 Haluzak
7,862,147 B2 1/2011 Ciminelli et al.
7,877,875 B2 2/2011 O'Farrell et al.
8,063,318 B2 11/2011 Williams et al.
8,101,438 B2 1/2012 McAvoy et al.
8,163,463 B2 4/2012 Kim et al.
8,177,330 B2 5/2012 Suganuma
8,197,031 B2 6/2012 Stephens et al.
8,235,500 B2 8/2012 Nystrom et al.
8,246,141 B2 8/2012 Petruchik et al.
8,272,130 B2 9/2012 Miyazaki
8,287,104 B2 10/2012 Sharan et al.
8,342,652 B2 1/2013 Nystrom et al.
8,405,232 B2 3/2013 Hsu et al.
8,429,820 B2 4/2013 Koyama et al.
8,439,485 B2 5/2013 Tamaru et al.
8,485,637 B2 7/2013 Dietl
9,724,920 B2 8/2017 Chen et al.
9,944,080 B2 4/2018 Chen
2001/0037808 A1 11/2001 Deem et al.
2002/0024569 A1 * 2/2002 Silverbrook ..... B41J 2/04528 347/85
2002/0030720 A1 3/2002 Kawamura et al.
2002/0033867 A1 * 3/2002 Silverbrook ..... B41J 2/14 347/85
2002/0051036 A1 5/2002 Scheffelin et al.
2002/0180825 A1 12/2002 Buswell et al.
2002/0180846 A1 12/2002 Silverbrook
2003/0052944 A1 3/2003 Scheffelin
2003/0140496 A1 7/2003 Buswell et al.
2003/0186474 A1 10/2003 Haluzak et al.
2002/0210727 12/2003 Buswell et al.
2004/0032468 A1 2/2004 Killmeier et al.
2004/0055145 A1 3/2004 Buswell
2004/0084404 A1 5/2004 Donaldson
2004/0095422 A1 5/2004 Eguchi et al.
2004/0119774 A1 * 6/2004 Conta ..... B41J 2/14145 347/20
2004/0196334 A1 10/2004 Cornell
2004/0201641 A1 10/2004 Brugue et al.
2004/0233254 A1 11/2004 Kim
2005/0018016 A1 * 1/2005 Silverbrook ..... B41J 2/14314 347/54
2005/0024444 A1 2/2005 Conta et al.
2005/0030358 A1 2/2005 Haines
2005/0116995 A1 6/2005 Tanikawa et al.
2005/0122378 A1 6/2005 Touge
2005/0162466 A1 * 7/2005 Silverbrook ..... B41J 2/14 347/42
2006/0022273 A1 2/2006 Halk
2006/0028510 A1 2/2006 Park et al.
2006/0066674 A1 3/2006 Sugahara
2006/0132543 A1 6/2006 Elrod et al.
2006/0243387 A1 11/2006 Haluzak
2006/0256162 A1 * 11/2006 Hayakawa ..... B41J 2/14032 347/65
2007/0139470 A1 * 6/2007 Lee ..... B41J 2/155 347/43
2007/0153070 A1 7/2007 Haines et al.
2007/0188561 A1 8/2007 Eguchi et al.
2008/0061393 A1 3/2008 Yen
2008/0079781 A1 4/2008 Shim et al.
2008/0149024 A1 6/2008 Petruchik et al.
2008/0174636 A1 7/2008 Kim et al.
2007/0738654 10/2008 Haluzak et al.
2008/0239002 A1 10/2008 Nystrom et al.
2008/0259125 A1 10/2008 Haluzak et al.
2008/0291243 A1 11/2008 Osaki
2008/0292986 A1 11/2008 Park et al.
2008/0297564 A1 12/2008 Jeong et al.
2009/0009559 A1 1/2009 Jindai et al.
2009/0014413 A1 1/2009 Nystrom et al.
2009/0022199 A1 1/2009 Jikutani
2009/0086449 A1 4/2009 Minamio et al.
2009/0225131 A1 9/2009 Chen et al.
2009/0267994 A1 10/2009 Suganuma et al.
2010/0035373 A1 2/2010 Hunziker et al.
2010/0079542 A1 4/2010 Ciminelli et al.
2010/0156989 A1 6/2010 Petruchik
2010/0224983 A1 9/2010 Huang et al.
2010/0271445 A1 10/2010 Sharan et al.
2011/0019210 A1 1/2011 Chung et al.

(56) References Cited

U.S. PATENT DOCUMENTS

| | | | | |
|---|---|---|---|---|
| 2011/0037808 | A1* | 2/2011 | Ciminelli | B41J 2/14072 347/50 |
| 2011/0080450 | A1 | 4/2011 | Ciminelli et al. | |
| 2011/0141691 | A1 | 6/2011 | Slaton et al. | |
| 2011/0222239 | A1 | 9/2011 | Dede | |
| 2011/0292121 | A1 | 12/2011 | McAvoy et al. | |
| 2011/0292124 | A1 | 12/2011 | Anderson et al. | |
| 2011/0292126 | A1 | 12/2011 | Nystrom et al. | |
| 2011/0296688 | A1 | 12/2011 | Fielder et al. | |
| 2011/0298868 | A1 | 12/2011 | Fielder et al. | |
| 2011/0304673 | A1 | 12/2011 | Ciminelli et al. | |
| 2012/0000595 | A1* | 1/2012 | Mase | B41J 2/1637 156/89.11 |
| 2012/0019593 | A1 | 1/2012 | Scheffelin et al. | |
| 2012/0120158 | A1 | 5/2012 | Sakai et al. | |
| 2012/0124835 | A1 | 5/2012 | Okano et al. | |
| 2012/0186079 | A1 | 7/2012 | Ciminelli | |
| 2012/0210580 | A1 | 8/2012 | Dietl | |
| 2012/0212540 | A1 | 8/2012 | Dietl | |
| 2012/0242752 | A1 | 9/2012 | Mou | |
| 2013/0026130 | A1 | 1/2013 | Watanabe | |
| 2013/0027466 | A1 | 1/2013 | Petruchik et al. | |
| 2013/0029056 | A1* | 1/2013 | Asai | B41J 2/1603 427/487 |
| 2013/0194349 | A1 | 8/2013 | Ciminelli et al. | |
| 2016/0001552 | A1 | 1/2016 | Chen | |
| 2016/0001558 | A1 | 1/2016 | Chen et al. | |
| 2016/0009084 | A1 | 1/2016 | Chen | |
| 2016/0016404 | A1 | 1/2016 | Chen et al. | |
| 2017/0008281 | A1 | 1/2017 | Chen et al. | |
| 2018/0141337 | A1 | 5/2018 | Chen | |
| 2018/0326724 | A1 | 11/2018 | Chen | |

FOREIGN PATENT DOCUMENTS

| | | | | |
|---|---|---|---|---|
| CN | 1286172 | A | 3/2001 | |
| CN | 1297815 | A | 6/2001 | |
| CN | 1314244 | | 9/2001 | |
| CN | 1512936 | A | 7/2004 | |
| CN | 1530229 | | 9/2004 | |
| CN | 1541839 | A | 11/2004 | |
| CN | 1593924 | A | 3/2005 | |
| CN | 1622881 | | 6/2005 | |
| CN | 1872554 | | 12/2006 | |
| CN | 101020389 | | 8/2007 | |
| CN | 101163591 | | 4/2008 | |
| CN | 101274523 | A | 10/2008 | |
| CN | 101372172 | | 2/2009 | |
| CN | 101607477 | A | 12/2009 | |
| CN | 101668698 | A | 3/2010 | |
| CN | 101909893 | | 12/2010 | |
| CN | 102470672 | A | 5/2012 | |
| CN | 102596575 | A | 7/2012 | |
| CN | 102673155 | | 9/2012 | |
| CN | 103052508 | A | 4/2013 | |
| DE | 102011078906 | A1 | 1/2013 | |
| EP | 0705698 | A2 | 4/1996 | |
| EP | 1027991 | A2 | 8/2000 | |
| EP | 1095773 | | 5/2001 | |
| EP | 1080907 | | 7/2001 | |
| EP | 1386740 | A1 | 2/2004 | |
| EP | 1518685 | A1 | 3/2005 | |
| EP | 1827844 | | 9/2007 | |
| EP | 1908593 | A1 | 4/2008 | |
| JP | 60262649 | | 12/1985 | |
| JP | 61-125852 | * | 6/1986 | B41J 2/045 |
| JP | 61125852 | A | 6/1986 | |
| JP | 62240562 | | 10/1987 | |
| JP | 62240562 | A | 10/1987 | |
| JP | H04-292950 | | 10/1992 | |
| JP | H06-015824 | | 2/1994 | |
| JP | H06-226977 | | 8/1994 | |
| JP | H07-227970 | | 8/1995 | |
| JP | H09-001812 | | 1/1997 | |
| JP | H09-029970 | | 2/1997 | |
| JP | H09-131871 | | 5/1997 | |
| JP | H11091108 | | 4/1999 | |
| JP | H11-208000 | | 8/1999 | |
| JP | 2001071490 | | 3/2001 | |
| JP | 2000108360 | | 4/2001 | |
| JP | 2001-246748 | | 9/2001 | |
| JP | 2003-011365 | | 1/2003 | |
| JP | 2003-063010 | | 3/2003 | |
| JP | 2003-063020 | | 3/2003 | |
| JP | 2003063020 | A | 3/2003 | |
| JP | 2004-148827 | | 5/2004 | |
| JP | 2004-517755 | | 6/2004 | |
| JP | 2005-088587 | | 4/2005 | |
| JP | 2005161710 | | 6/2005 | |
| JP | 2005212134 | | 8/2005 | |
| JP | 2006-009149 | | 1/2006 | |
| JP | 2006315321 | A | 11/2006 | |
| JP | 2006321222 | | 11/2006 | |
| JP | 2007531645 | | 11/2007 | |
| JP | 2008-087478 | | 4/2008 | |
| JP | 2009-255448 | | 11/2009 | |
| JP | 2010023341 | | 2/2010 | |
| JP | 2010050452 | A | 3/2010 | |
| JP | 2010137460 | | 6/2010 | |
| JP | 2010-524713 | | 7/2010 | |
| JP | 2010524713 | | 7/2010 | |
| JP | 2011240516 | | 12/2011 | |
| JP | 2012-158150 | | 8/2012 | |
| JP | 2013501655 | | 1/2013 | |
| KR | 20040097848 | | 11/2004 | |
| TW | 20093685 | A | 9/2009 | |
| TW | 200936385 | A | 9/2009 | |
| TW | 201144081 | A | 12/2011 | |
| WO | WO-2008134202 | | 11/2008 | |
| WO | WO-2008134202 | A1 | 11/2008 | |
| WO | WO-2008151216 | A1 | 12/2008 | |
| WO | WO-2010005434 | | 1/2010 | |
| WO | WO-2011019529 | A1 | 2/2011 | |
| WO | WO-2011058719 | | 5/2011 | |
| WO | WO-2012011972 | | 1/2012 | |
| WO | WO-2012023941 | | 2/2012 | |
| WO | WO-2012106661 | | 8/2012 | |
| WO | WO-2012134480 | | 10/2012 | |
| WO | WO-2012168121 | | 12/2012 | |
| WO | WO-2014/133575 | | 9/2014 | |
| WO | WO-2014/133577 | | 9/2014 | |
| WO | WO-2014/133578 | | 9/2014 | |
| WO | WO-2014/133600 | | 9/2014 | |
| WO | WO-201413 516 | A1 | 9/2014 | |
| WO | WO-2014133561 | | 9/2014 | |
| WO | WO-2014133576 | | 9/2014 | |
| WO | WO-2014153305 | A1 | 9/2014 | |

OTHER PUBLICATIONS

Kumar et al; "Wafer Level Embedding Technology for 3D Wafer Level Embedded Package"; 2009 Electronic Components and Technology Conference.

Lee et al; "A Thermal Inkjet Printhead with a Monolithically Fabricated Nozzle Plate and Self-Aligned Ink Feed Hole"; Journal of Mioroeleotromechanical Systems, vol. 8, No. 3, Sep. 1999.

Lindemann; "One Inch Thermal Bubble Jet Printhead With Laser Structured Integrated Polyimide Nozzle Plate"; Journal of Microelectromechanical Systems, vol. 16, No. 2, Apr. 2007.

Chen Yue Cheng et al.; A Monolithic Thermal Inkjet Printhead Combining Anisotropic Etching and Electro Plating; In Input/Output and Imaging Technologies II, 246 Proceedings of SPIE vol. 4080 Jul. 26-27, 2007; pp. 245-252.

European Patent Office, Communication pursuant to Rule 164(1) EPC for Appl. No. 13876407.1 dated Jan. 5, 2017 (7 pages).

European Patent Office, Extended European Search Report for Appl. No. 13876407.1 dated May 31, 2017 (18 pages).

Hayes, D.J. et al.; Microjet Printing of Solder and Polymers for Multi-chip Modules and Chip-scale Packages ; http://citeseerxist.psu.edu/viewdoc/download?doi=10.1.1.88.3951&rev=rep1&type=pdf ; May 14, 1999 (6 pages).

(56) References Cited

OTHER PUBLICATIONS

Korean Intellectual Property Office, International Search Report and Written Opinion for PCT/US2013/062221 dated Dec. 19, 2013 (13 pages).

* cited by examiner

TRANSFER MOLDED FLUID FLOW STRUCTURE

BACKGROUND

A printhead die in an inkjet pen or print bar includes a plurality of fluid ejection elements on a surface of a silicon substrate. Fluid flows to the ejection elements through a fluid delivery slot formed in the substrate between opposing substrate surfaces. While fluid delivery slots adequately deliver fluid to fluid ejection elements, there are some disadvantages with such slots. From a cost perspective, for example, fluid delivery slots occupy valuable silicon real estate and add significant slot processing cost. In addition, lower printhead die cost is achieved in part through shrinking the die, which in turn results in a tightening of the slot pitch and/or slot width in the silicon substrate. However, shrinking the die and the slot pitch increases the inkjet pen costs associated with integrating the small die into the pen during assembly. From a structural perspective, removing material from the substrate to form an ink delivery slot weakens the printhead die. Thus, when a single printhead die has multiple slots (e.g., to provide different colors in a multicolor printhead die, or to improve print quality and speed in a single color printhead die), the printhead die becomes increasingly fragile with the addition of each slot.

BRIEF DESCRIPTION OF THE DRAWINGS

The present embodiments will now be described, by way of example, with reference to the accompanying drawings, in which.

Throughout the drawings, identical reference numbers designate similar, but not necessarily identical, elements.

DETAILED DESCRIPTION

Overview

Figure 1:
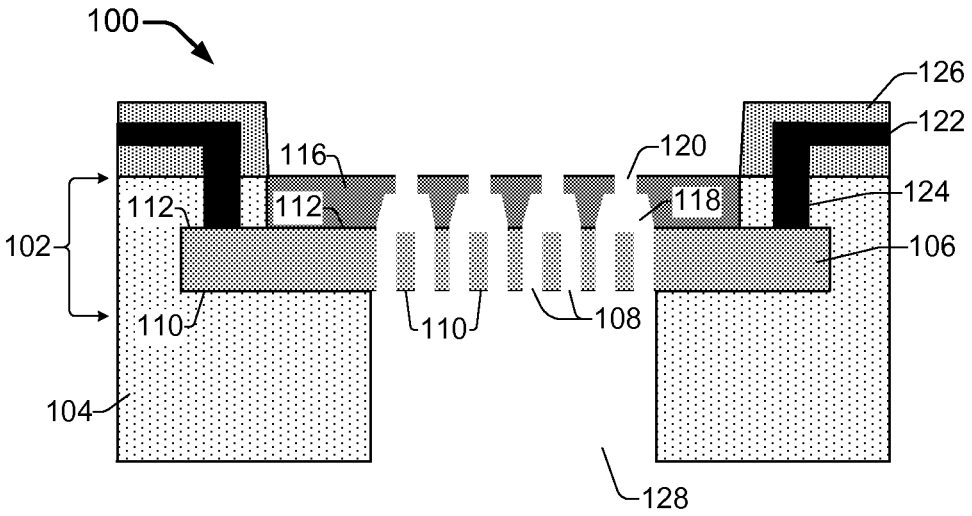
FIG. 1 is an elevation section view illustrating one example of a molded fluid flow structure implemented as a printhead structure.

Reducing the cost of conventional inkjet printhead dies has been achieved in the past through shrinking the die size and reducing wafer costs. The die size depends significantly on the pitch of fluid delivery slots that deliver ink from a reservoir on one side of the die to fluid ejection elements on another side of the die. Therefore, prior methods used to shrink the die size have mostly involved reducing the slot pitch and size through a silicon slotting process that can include, for example, laser machining, anisotropic wet etching, dry etching, combinations thereof, and so on. Unfortunately, the silicon slotting process itself adds considerable cost to the printhead die. In addition, successful reductions in slot pitch are increasingly met with diminishing returns, as the costs associated with integrating the shrinking die (resulting from the tighter slot pitch) with an inkjet pen have become excessive.

A transfer molded fluid flow structure enables the use of smaller printhead dies and a simplified method of forming fluid delivery channels to deliver ink from a reservoir on one side of a printhead die to fluid ejection elements on another side of the die. The fluid flow structure includes one or more printhead dies transfer molded into a monolithic body of plastic, epoxy mold compound, or other moldable material. For example, a print bar implementing the fluid flow structure includes multiple printhead dies transfer molded into an elongated, singular molded body. The molding enables the use of smaller dies by offloading the fluid delivery channels (i.e., the ink delivery slots) from the die to the molded body of the structure. Thus, the molded body effectively grows the size of each die which improves opportunities for making external fluid connections and for attaching the dies to other structures.

The fluid flow structure includes molded fluid delivery channels formed in the structure at the back of each die using a transfer molding process at the wafer or panel level. The transfer mold process provides an overall cost reduction when forming the fluid delivery channels/slots compared to traditional silicon slotting processes. In addition, the transfer mold process enables added flexibility in the molded slot shape, its length, and its side-wall profile, through changes in the topography or design of the mold chase top.

The described fluid flow structure is not limited to print bars or other types of printhead structures for inkjet printing, but may be implemented in other devices and for other fluid flow applications. Thus, in one example, the new structure includes a micro device embedded in a molding having a channel or other path for fluid to flow directly into or onto the device. The micro device can be, for example, an electronic device, a mechanical device, or a microelectromechanical system (MEMS) device. The fluid flow, for example, could be a cooling fluid flow into or onto the micro device, or a fluid flow into a printhead die or other fluid dispensing micro device. These and other examples shown in the figures and described below illustrate but do not limit the invention, which is defined in the Claims following this Description.

As used in this document, a "micro device" means a device having one or more exterior dimensions less than or equal to 30 mm; "thin" means a thickness less than or equal to 650 μm; a "sliver" means a thin micro device having a ratio of length to width (L/W) of at least three; a "printhead structure" and a "printhead die" mean that part of an inkjet printer or other inkjet type dispenser that dispenses fluid from one or more openings. A printhead structure includes one or more printhead dies. "Printhead structure" and "printhead die" are not limited to printing with ink and other printing fluids but also include inkjet type dispensing of other fluids for uses other than or in addition to printing.

Illustrative Embodiments

FIG. 1 is an elevation section view illustrating one example of a transfer molded fluid flow structure 100 implemented as a printhead structure 100 that is suitable for use in a print bar of an inkjet printer. The printhead structure 100 includes a micro device 102 molded into a monolithic body 104 of plastic or other moldable material. A molded body 104 may also be referred to herein as a molding 104. In general, a micro device 102 could be, for example, an electronic device, a mechanical device, or a microelectromechanical system (MEMS) device. In the present printhead structure 100 of FIG. 1, micro device 102 is implemented as a printhead die 102. Printhead die 102 includes a silicon die substrate 106 comprising a thin silicon sliver on the order of 100 microns in thickness. The silicon substrate 106 includes fluid feed holes 108 dry etched or otherwise formed therein to enable fluid flow through the substrate 106 from a first exterior surface 110 to a second exterior surface 112.

Formed on the second exterior surface 112 of substrate 106 are one or more layers 116 that define a fluidic architecture that facilitates the ejection of fluid drops from the printhead structure 100. The fluidic architecture defined by layers 116 generally includes ejection chambers 118 having corresponding orifices 120, a manifold (not shown), and other fluidic channels and structures. The layer(s) 116 can include, for example, a chamber layer formed on the substrate 106 with a separately formed orifice layer over the chamber layer, or they can include a monolithic layer that combines the chamber and orifice layers. Layer(s) 116 are typically formed of an SU8 epoxy or some other polyimide material.

In addition to the fluidic architecture defined by layer(s) 116 on silicon substrate 106, the printhead die 102 includes integrated circuitry formed on the substrate 106. Integrated circuitry is formed using thin film layers and other elements not specifically shown in FIG. 1. For example, corresponding with each ejection chamber 118 is a thermal ejector element or a piezoelectric ejector element formed on the second exterior surface 112 of substrate 106. The ejection elements are actuated to eject drops or streams of ink or other printing fluid from chambers 118 through orifices 120.

The printhead structure 100 also includes signal traces or other conductors 122 connected to printhead die 102 through electrical terminals 124 formed on substrate 106. Conductors 122 can be formed on structure 100 in various ways. For example, conductors 122 can be formed in an insulating layer 126 as shown in FIG. 1, using a lamination or deposition process. Insulating layer 126 is typically a polymer material that provides physical support and insulation for conductors 122. In other examples, conductors 122 can be molded into the molded body 104 as shown below with regard to FIGS. 6-7 and 9-15.

A transfer molded fluid channel 128 is formed into the molded body 104, and connects with the printhead die substrate 106 at the exterior surface 110. The transfer molded fluid channel 128 provides a pathway through the molded body that enables fluid to flow directly onto the silicon substrate 106 at exterior surface 110, and into the silicon substrate 106 through the fluid feed holes 108, and then into chambers 118. As discussed in further detail below, the fluid channel 128 is formed into the molded body 104 using a transfer molding process that enables the formation of a variety of different channel shapes whose profiles each reflect the inverse shape of whatever mold chase topography is used during the molding process.

Figure 2:
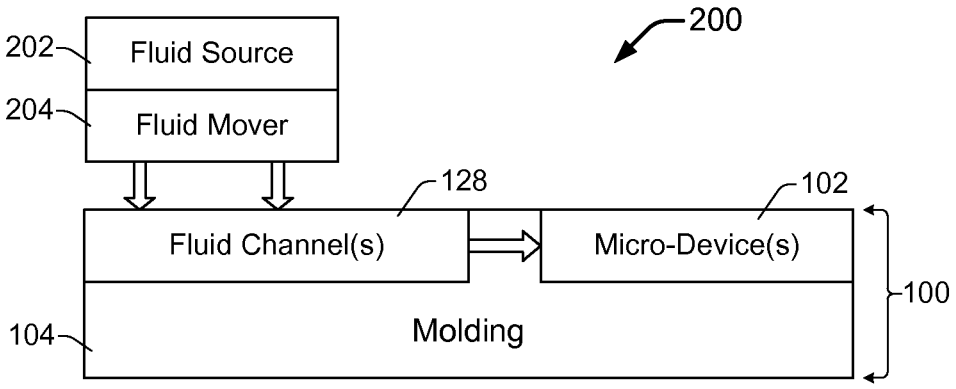
FIG. 2 is a block diagram illustrating an example system implementing a molded fluid flow structure such as the printhead structure of FIG. 1.

FIG. 2 is a block diagram illustrating a system 200 implementing a transfer molded fluid flow structure 100 such as the printhead structure 100 shown in FIG. 1. System 200 includes a fluid source 202 operatively connected to a fluid mover 204 configured to move fluid to a transfer molded channel 128 formed in the fluid flow structure 100. A fluid source 202 might include, for example, the atmosphere as a source of air to cool an electronic micro device 102, or a printing fluid supply for a printhead die 102. Fluid mover 204 represents a pump, a fan, gravity or any other suitable mechanism for moving fluid from source 202 to flow structure 100.

Figure 3:
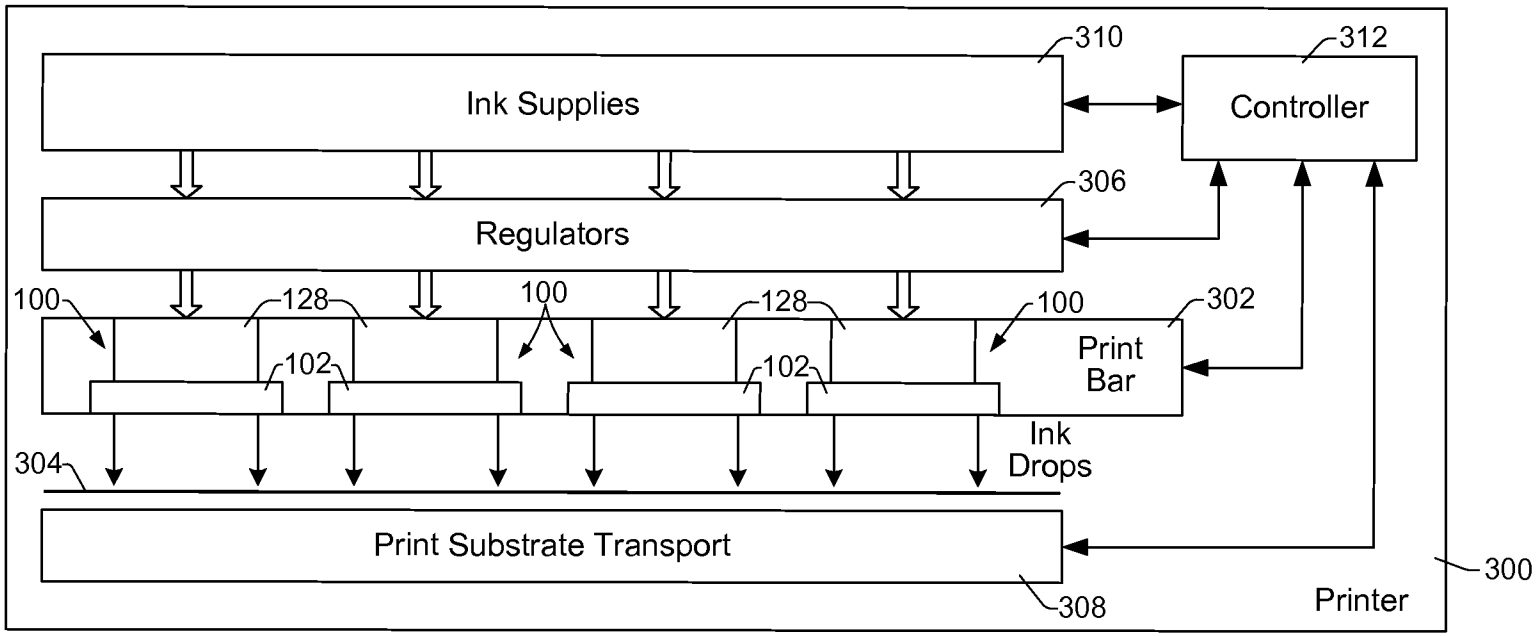
FIG. 3 is a block diagram illustrating an inkjet printer implementing one example of a fluid flow structure in a substrate wide print bar.

FIG. 3 is a block diagram illustrating an inkjet printer 300 implementing one example of a fluid flow structure 100 in a substrate wide print bar 302. Printer 300 includes print bar 302 spanning the width of a print substrate 304, flow regulators 306 associated with print bar 302, a substrate transport mechanism 308, ink or other printing fluid supplies 310, and a printer controller 312. Controller 312 represents the programming, processor(s) and associated memories, along with other electronic circuitry and components needed to control the operative elements of a printer 300. Print bar 302 includes an arrangement of printhead dies 102 for dispensing printing fluid on to a sheet or continuous web of paper or other print substrate 304. Each printhead die 102 receives printing fluid through a flow path that extends from supplies 310 into and through flow regulators 306, and then through transfer molded fluid channels 128 in print bar 302.

Figure 4:
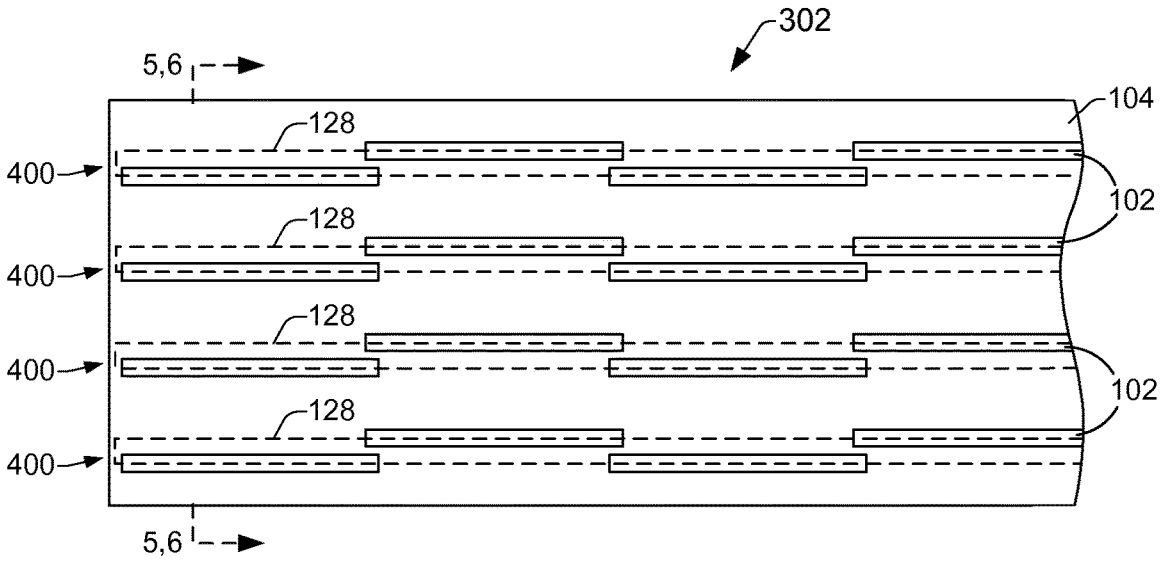
FIGS. 4-6 illustrate an inkjet print bar implementing one example of a molded fluid flow structure as a printhead structure suitable for use in printer.
Figure 5:
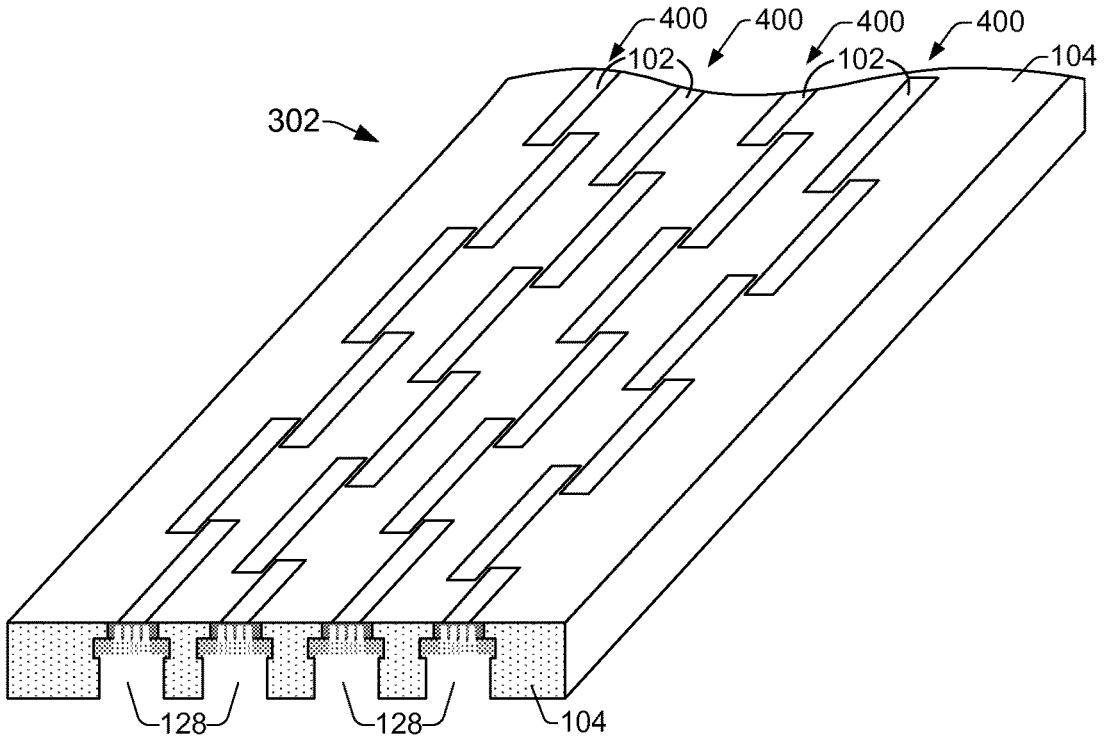
Figure 6:
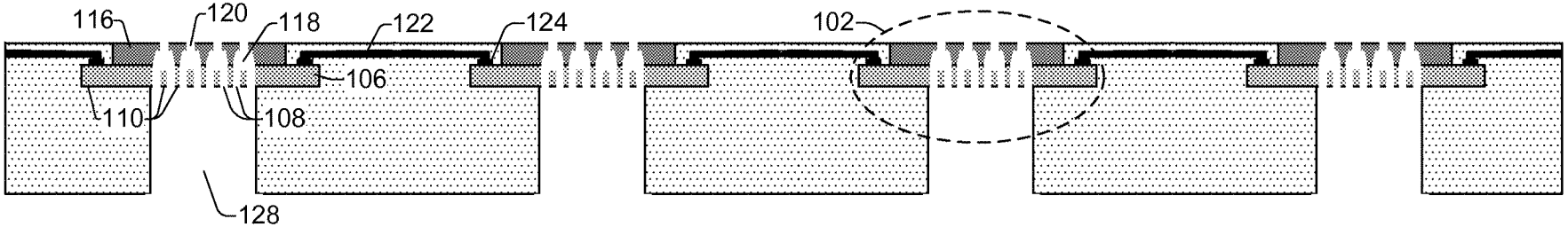

FIGS. 4-6 illustrate an inkjet print bar 302 implementing one example of a transfer molded fluid flow structure 100 as a printhead structure 100 suitable for use in printer 300 of FIG. 3. Referring to the plan view of FIG. 4, printhead dies 102 are embedded in an elongated, monolithic molding 104 and arranged generally end to end in rows 400. The printhead dies 102 are arranged in a staggered configuration in which the dies in each row overlap another printhead die in that same row. In this configuration, each row 400 of printhead dies 102 receives printing fluid from a different transfer molded fluid channel 128 (illustrated with dashed lines in FIG. 4). Although four fluid channels 128 feeding four rows 400 of staggered printhead dies 102 is shown (e.g., for printing four different colors), other suitable configurations are possible. FIG. 5 illustrates a perspective section view of the inkjet print bar 302 taken along line 5-5 in FIG. 4, and FIG. 6 illustrates a section view of the inkjet print bar 302 taken along line 5-5 in FIG. 4. The section view of FIG. 6 shows various details of a printhead structure 100 as discussed above with respect to FIG. 1.

While a particular shape or configuration of a transfer molded fluid channel 128 has been generally illustrated and discussed with reference to FIGS. 1-6, a variety of differently shaped fluid channels 128 can be formed using a transfer mold process. As discussed below, FIGS. 9-15 illustrate examples of differently shaped, transfer molded fluid channels 128 that can be readily formed into a molded body 104 of a fluid flow structure 100 using mold chase tops that have varying topographical designs.

Figure 7A:
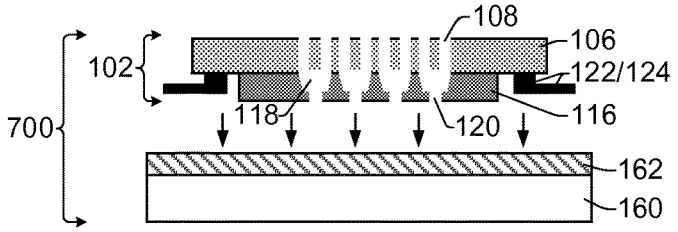
FIGS. 7*a-e* illustrate an example transfer molding process for making a molded printhead fluid flow structure having a transfer molded fluid channel.

Referring now to FIGS. 7*a-e*, an example transfer molding process for making a molded printhead fluid flow structure 100 having a transfer molded fluid channel 128 is illustrated. FIG. 8 is a corresponding flow diagram 800 of the process illustrated in FIGS. 7*a-e*. As shown in FIG. 7*a*, a printhead die 102 is attached to a carrier 160 using a thermal release tape 162 (step 802 in FIG. 8), forming a die carrier assembly 700. The printhead die 102 is placed with the orifice (120) side down onto the carrier 160, as indicated by the direction arrows. The printhead die 102 is in a pre-processed state such that it already includes layer(s) 116 defining fluidic architectures (e.g., ejection chambers 118, orifices 120), and electrical conductors and terminals 122/124, and ejection elements (not shown) formed on sliver substrate 106. Fluid feed holes 108 have also already been dry etched or otherwise formed in the thin sliver substrate 106.

Figure 7B:
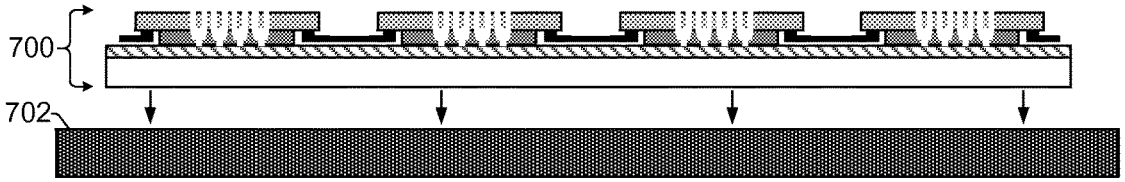
Figure 7C:
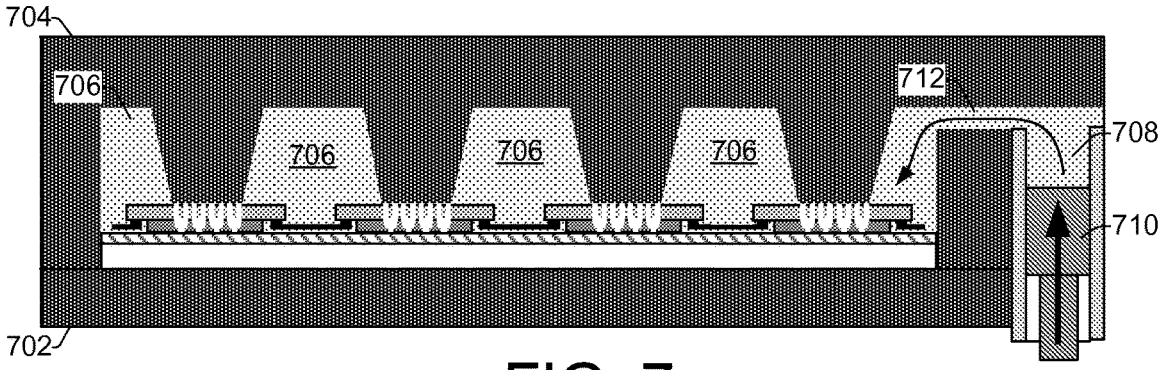
Figure 8:
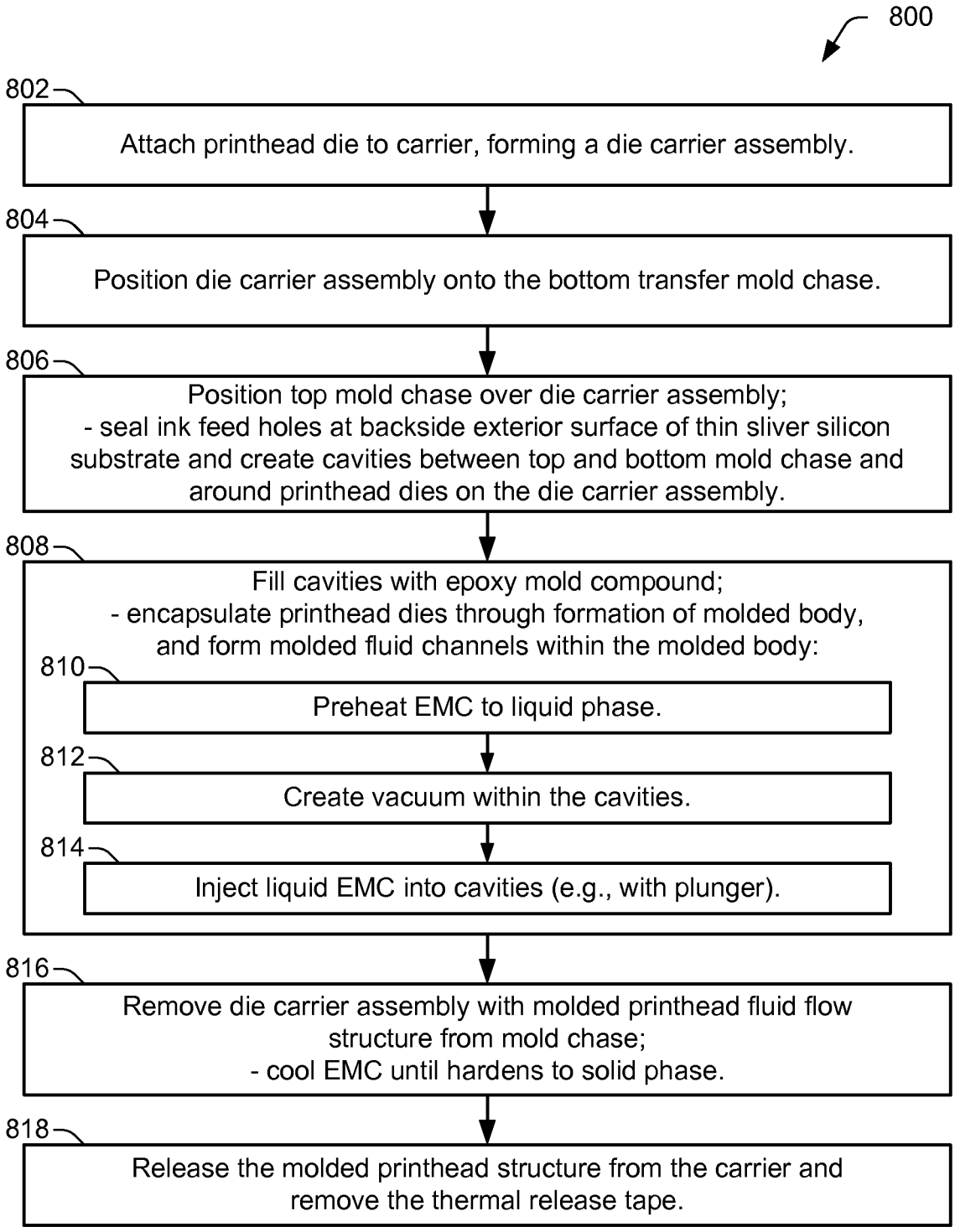
FIG. 8 illustrates is a flow diagram of an example transfer molding process corresponding with FIGS. 7*a-e;*

In a next step, FIG. 7*b* shows a die carrier assembly 700 similar to the one prepared as shown in FIG. 7*a*, except that four printhead dies 102 have been attached to the carrier 160. As shown in FIG. 7*b*, once the dies are attached to the carrier 160, the die carrier assembly 700 is positioned onto the bottom transfer mold chase 702 (step 804 in FIG. 8). As shown in FIG. 7*c*, after the die carrier assembly 700 is positioned onto the bottom transfer mold chase 702, the top of the transfer mold chase 704 is brought down into position over the die carrier assembly 700 (step 806 in FIG. 8). While the top mold chase 704 can have varying topographies to form differently shaped transfer molded fluid channels 128 into the body 104 of a fluid flow structure 100 (e.g., see FIGS. 9-15), in any case, the topography of the top mold chase 704 is designed such that when positioned over and brought down on the die carrier assembly 700, the mold chase seals the ink feed holes 108 at the backside exterior surface 110 of the thin sliver silicon substrate 106. Positioning the top mold chase 704 over the die carrier assembly 700 seals the ink feed holes 108 and creates cavities 706 between the top and bottom mold chase and around the printhead dies 102 on the die carrier assembly 700. An optional release film can be vacuum held down and conformed to the transfer mold chase to prevent contamination to the transfer mold chase 704 and to minimize the Epoxy mold flash during the transfer mold process.

Referring still to FIG. 7*c*, in a next step, the cavities 706 are filled with an epoxy molding compound 708 (EMC) or other suitable moldable material (step 808 in FIG. 8). Filling the cavities 706 with EMC forms the molded body 104 that encapsulates the printhead dies 102, and also forms the molded fluid channels 128 within the molded body 104. Typically, filling cavities 706 with EMC involves preheating the EMC until it reaches a melting temperature and becomes a liquid (step 810 in FIG. 8). A vacuum may be created within the cavities 706, and the liquid EMC is then injected using a plunger 710, for example, through runners 712 (i.e., channels) of the mold chase until it reaches and fills the cavities 706 (steps 812 and 814 in FIG. 8). The seals over the ink feed holes 108 created by the top mold chase 704 prevent the EMC from entering the ink feed holes as the cavities are being filled.

Figure 7D:
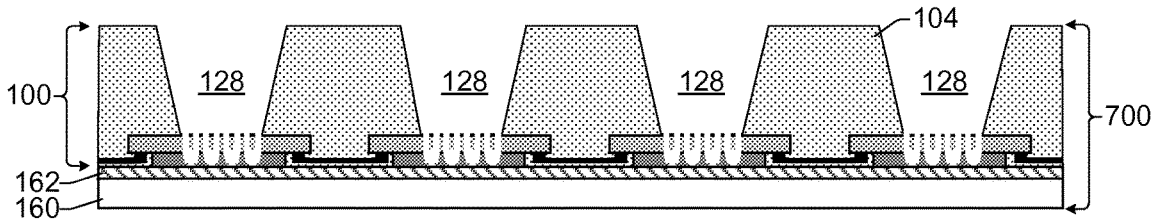
Figure 7E:
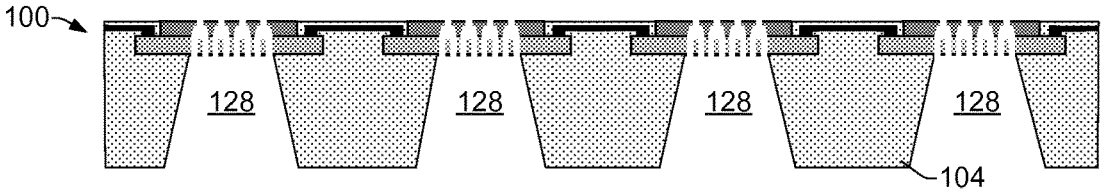

After the EMC cools and hardens to a solid, the die carrier assembly 700, which now includes the attached molded printhead fluid flow structure 100, can be removed from the mold chase, as shown in FIG. 7*d* (step 816 in FIG. 8). FIG. 7*d* shows the molded printhead fluid flow structure 100 attached to the carrier 160 by the thermal release tape 162. The molded printhead structure 100 is then released from the carrier 160 and the thermal release tape 162 is removed, as shown in FIG. 7*e* (step 818 in FIG. 8). Thus, in this implementation the molded printhead structure 100 is formed in a transfer mold process. The position of the molded printhead structure 100 in FIG. 7*e* has been inverted to be consistent with the views of the molded printhead fluid flow structures 100 shown in FIGS. 6 and 9-15.

As mentioned above, the use of a mold chase top 704 in a transfer molding process enables the formation of many differently shaped fluid channels 128. This is achieved by providing mold chase tops 704 that have varying topographical designs. In general, the resulting shapes of the fluid channels 128 follow, inversely, the contours of the topography of the top mold chase 704 used in the transfer mold process. FIGS. 9-15 illustrate several examples of differently shaped, transfer molded fluid channels 128.

Figure 9:
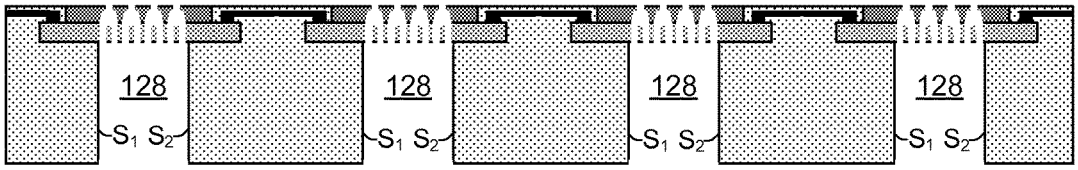
FIGS. 9-15 illustrate various examples of differently shaped, transfer molded fluid channels that can be formed into a molded body through a transfer mold process.
Figure 10:
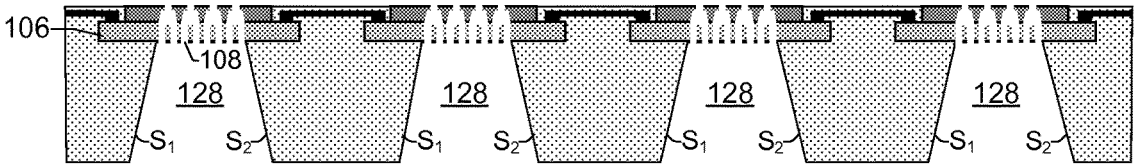
Figure 11:
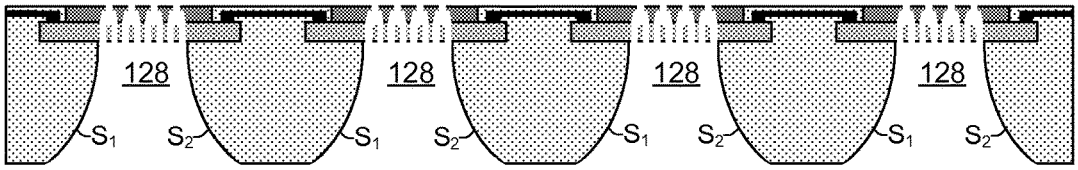
Figure 12:
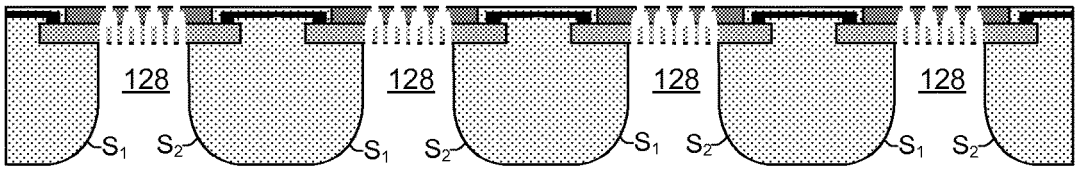
Figure 13:
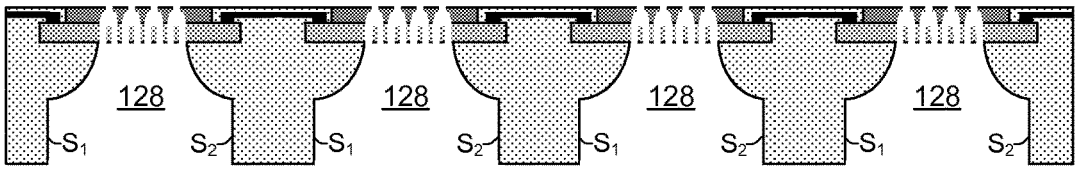
Figure 14:
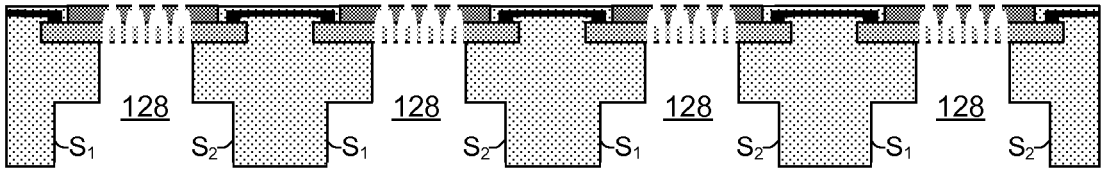
Figure 15:
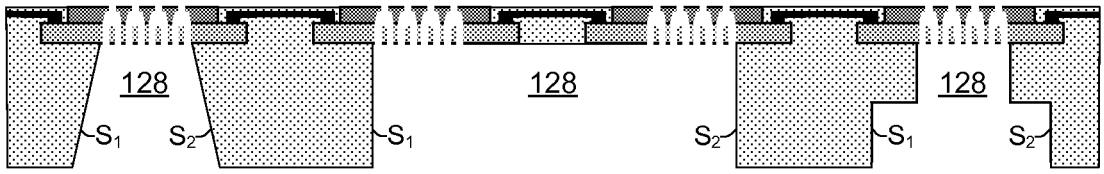

Referring to FIG. 9, transfer molded fluid channels 128 have been formed with first and second side walls, $S_1$ and $S_2$, that are substantially straight and parallel to one another. FIG. 10 shows transfer molded fluid channels 128 whose side walls $S_1$ and $S_2$, are straight and tapered with respect to one another. The tapered side walls taper inward toward one another as they get closer to the fluid feed holes 108 in substrate 106, and away from one another as they recede from substrate 106. In FIG. 11, the side walls $S_1$ and $S_2$ of the transfer molded fluid channels 128 are curved inward in a manner that narrows the channels as they approach the fluid feed holes 108 in substrate 106. The transfer molded fluid channels 128 of FIGS. 12 and 13 show examples of sidewalls that include straight wall portions that are parallel to one another, and curved wall portions that mirror one another. Thus, a single side wall of a transfer molded fluid channel 128 can have multiple shape profiles such as straight, slanted, and curved profiles, in varying combinations and configurations. FIG. 14 shows transfer molded fluid channels 128 whose side walls $S_1$ and $S_2$, each have two straight sections that are substantially parallel to the opposite sidewall sections. FIG. 15 shows an example of a monolithic transfer molded printhead structure 100 whose multiple molded fluid channels 128 are shaped differently among themselves. In this example, one channel includes side walls with tapered shapes while another channel includes side walls with straight shapes. In addition, the center fluid channel shown in FIG. 15 illustrates one example of how transfer molded fluid channels can be formed to be fluidically coupled with multiple thin silicon sliver substrates 106 for multiple printhead dies 102.

In general, the transfer molded fluid channels 128 shown in FIGS. 9-15 have channel side walls, $S_1$ and $S_2$, formed in various straight and/or curved configurations that are parallel and/or tapered and/or mirrored to one another. In most cases, it is beneficial to have the channel side walls diverge or taper away from one another as they recede (i.e., move away) from the printhead sliver substrate 106. This divergence provides the benefit of assisting air bubbles move away from the orifices 120, ejection chambers 118, and fluid feed holes 108, where they may otherwise hinder or prevent the flow of fluid. Accordingly, the fluid channels 128 shown in FIGS. 9-15 comprise side walls that are typically divergent, but that are at least parallel, as they recede from the sliver substrate 106. However, the illustrated channel side wall shapes and configurations are not intended to be a limitation as to other shapes and configurations of side walls within fluid channels 128 that can be formed using a transfer molding process. Rather, this disclosure contemplates that other transfer molded fluid channels are possible that have side walls shaped in various other configurations not specifically illustrated or discussed.

What is claimed is:

1. A fluid flow structure, comprising:

a micro device embedded in a molding, the micro device comprising:

a chamber layer in which an ejection chamber is formed; and an orifice layer over the chamber layer in which an orifice is formed;

a fluid feed hole formed through the micro device; and multiple transfer molded fluid channels in the molding wherein:

each transfer molded fluid channel fluidically couples to a row of multiple micro devices; and each row of multiple micro devices receives fluid from a different transfer molded fluid channel.

2. The fluid flow structure of claim 1, wherein the channel has a shape with contours that inversely follow a topography of a mold chase used to form the fluid channel.

3. The fluid flow structure of claim 1, wherein the channel comprises first and second sidewalls that diverge from one another as they extend away from the micro device and converge toward one another as they near the micro device.

4. The fluid flow structure of claim 1, wherein the fluid channel comprises first and second straight side walls that are substantially parallel to one another.

5. The fluid flow structure of claim 1, wherein the channel comprises first and second straight side walls that are tapered with respect to one another.

6. The fluid flow structure of claim 1, wherein the fluid channel comprises first and second curved side walls that mirror one another, where each curved side wall is curved from the micro device to an opposite side of the molding from the micro device.

7. The fluid flow structure of claim 1, wherein the channel comprises first and second side walls, each side wall having multiple contours selected from the group consisting of a straight contour, a tapered contour, and a curved contour.

8. The fluid flow structure of claim 7, wherein the multiple contours of the first side wall mirror the multiple contours of the second side wall.

9. The fluid flow structure of claim 1, wherein the channels have different shapes.

10. The fluid flow structure of claim 1, wherein a single channel fluidically couples multiple substrates such that fluid can flow directly to the multiple substrates through the single channel.

11. The fluid flow structure of claim 1, wherein the method of making the transfer molded fluid channel in the fluid flow structure of claim 1, comprises:

attaching a printhead die to a carrier, forming a die carrier assembly;

positioning the die carrier assembly onto a bottom mold chase;

positioning a top mold chase over the die carrier assembly, creating a cavity between the top and bottom mold chases; and filling the cavity with epoxy mold compound.

12. The fluid flow structure of claim 11, wherein positioning a top mold chase over the die carrier assembly comprises sealing ink feed holes at a backside exterior surface of the printhead die.

13. The fluid flow structure of claim 11, wherein filling the cavity with epoxy mold compound comprises: forming a molded body that encapsulates the printhead die; and forming a molded fluid channel within the molded body through which fluid can flow directly to the printhead die.

14. The fluid flow structure of claim 13, further comprising:

cooling the epoxy mold compound;

removing the die carrier assembly with the molded body from the top and bottom mold chase; and releasing the molded body from the carrier.

15. The fluid flow structure of claim 11, wherein filing the cavity with epoxy mold compound comprises: preheating the epoxy mold compound to a liquid phase; creating a vacuum within the cavity; and injecting the liquid epoxy mold compound into the cavity.

16. The fluid flow structure of claim 1, wherein the fluid channel comprises first and second curved side walls that mirror one another, where the curved side walls are curved at an opening of the channel at an opposite side of the molding from the micro device such that the curved side walls narrow the channel from the opening toward the micro device.

17. The fluid flow structure of claim 1, wherein the fluid channel comprises first and second curved side walls that mirror one another, where the curved side walls are curved from a point inside the channel to the micro device such that the curved side walls narrow the channel from the point inside the channel toward the micro device, the side walls being parallel between the point inside the channel and an opening of the channel on an opposite side of the molding from the micro device.

18. The fluid flow structure of claim 1, wherein the micro device has:

a width of less than 30 millimeters;

a length of less than 30 millimeters; and a thickness of less than 100 microns.

19. A printhead comprising:

a fluid flow structure, the fluid flow structure comprising:

a micro device embedded in a monolithic body of moldable material, the micro device having a ratio of length to width (L/W) of at least three, the micro device comprising:

a chamber layer in which an ejection chamber is formed; and an orifice layer over the chamber layer in which an orifice is formed;

multiple fluid feed holes formed through a substrate of the micro device, wherein each ejection chamber receives fluid from at least two fluid feed holes; and multiple fluid channels defined in the moldable material, wherein:

each fluid channel is fluidically coupled to a single row of multiple micro devices, wherein:

micro devices are staggered in each row; and micro devices in each row overlap micro devices in the same row; and each row of multiple micro devices receives fluid from a different fluid channel.

20. The printhead of claim 19, wherein the fluid channel comprises first and second straight side walls that are substantially parallel to one another.

* * * * *